US009771902B2

(12) United States Patent
Polcyn et al.

(10) Patent No.: US 9,771,902 B2
(45) Date of Patent: Sep. 26, 2017

(54) EGR DEVICE HAVING ROTARY VALVE

(71) Applicants: DENSO International America, Inc., Southfield, MI (US); DENSO CORPORATION, Kariya, Aichi-pref. (JP)

(72) Inventors: Nicholas Polcyn, Commerce, MI (US); Jonathan Logan, Walled Lake, MI (US); Dallas Smolarek, Northville, MI (US)

(73) Assignee: DENSO International America, Inc., Southfield, MI (US)

( * ) Notice: Subject to any disclaimer, the term of this patent is extended or adjusted under 35 U.S.C. 154(b) by 301 days.

(21) Appl. No.: 14/561,344

(22) Filed: Dec. 5, 2014

(65) Prior Publication Data

US 2016/0160805 A1 Jun. 9, 2016

(51) Int. Cl.

| | |
|---|---|
| ***F02M 25/07*** | (2006.01) |
| ***F02M 26/70*** | (2016.01) |
| *F02M 26/19* | (2016.01) |
| *F02M 26/05* | (2016.01) |
| *F02M 26/06* | (2016.01) |

(52) U.S. Cl.

CPC ..... *F02M 26/70* (2016.02); *F02M 26/05* (2016.02); *F02M 26/06* (2016.02); *F02M 26/19* (2016.02)

(58) Field of Classification Search

CPC ..... F02M 26/70; F02M 26/06; F02M 26/65; F02M 26/68; F02M 26/69; F02M 26/71; F02M 26/72; F02M 26/19; F02M 26/05; F02B 29/0406

USPC ..... 123/568.18, 568.17

See application file for complete search history.

(56) References Cited

U.S. PATENT DOCUMENTS

| | | | | |
|---|---|---|---|---|
| 5,811,898 | A * | 9/1998 | Everingham | H01F 7/145 310/257 |
| 6,343,594 | B1 * | 2/2002 | Koeslin | F02M 26/19 123/568.11 |
| 6,378,509 | B1 * | 4/2002 | Feucht | F02M 26/43 123/568.12 |
| 6,928,993 | B2 * | 8/2005 | Yu | F02M 26/19 123/568.17 |
| 7,140,357 | B2 * | 11/2006 | Wei | F02B 29/0425 123/568.17 |
| 7,568,340 | B2 * | 8/2009 | Marsal | F02M 26/19 123/568.17 |
| 8,561,599 | B2 * | 10/2013 | Gingrich | F02M 26/43 123/568.17 |
| 9,222,442 | B2 * | 12/2015 | Wenzel | F02M 25/0722 |

(Continued)

FOREIGN PATENT DOCUMENTS

WO 2013-055361 A1 4/2013

*Primary Examiner* — Hai Huynh
*Assistant Examiner* — Gonzalo Laguarda

(57) ABSTRACT

An EGR device includes a housing having an outer pipe and an inner pipe. The inner pipe is accommodated in the outer pipe to define an annular passage externally with the outer pipe. The inner pipe defines an inner passage internally. The inner pipe has pipe through holes. A rotary valve is accommodated in the inner pipe. The rotary valve has valve through holes. The rotary valve is rotatable to communicate the annular passage with the inner passage through the valve through holes and the pipe through holes. The rotary valve is rotatable to block the inner passage from the annular passage.

17 Claims, 8 Drawing Sheets

(56) References Cited

U.S. PATENT DOCUMENTS

| | | | | |
|---|---|---|---|---|
| 2004/0112345 | A1* | 6/2004 | Bertilsson | F02M 26/40 123/568.17 |
| 2007/0039597 | A1* | 2/2007 | Zukouski | F02M 35/10222 123/568.17 |
| 2007/0256413 | A1* | 11/2007 | Marsal | F02M 26/05 60/605.2 |
| 2007/0271920 | A1 | 11/2007 | Marsal et al. | |
| 2012/0167863 | A1* | 7/2012 | Kulkarni | F02M 26/19 123/568.17 |
| 2012/0180478 | A1 | 7/2012 | Johnson et al. | |

* cited by examiner

EGR DEVICE HAVING ROTARY VALVE

TECHNICAL FIELD

The present disclosure relates to an EGR device having a rotary valve for an internal combustion engine of a vehicle.

BACKGROUND

A vehicle may be equipped with an exhaust gas recirculation system (EGR system). The EGR system is to reduce emission contained in exhaust gas discharged from an internal combustion engine. The EGR system may recirculate a part of exhaust gas into fresh air to produce mixture gas containing recirculated exhaust gas and fresh air. Recirculated exhaust gas may be unevenly mixed with fresh air to reduce combustion efficiency of the engine consequently.

SUMMARY

The present disclosure addresses the above-described concerns.

According to an aspect of the preset disclosure, an EGR device comprises a housing having an outer pipe and an inner pipe, the inner pipe accommodated in the outer pipe to define an annular passage externally with the outer pipe, the inner pipe defining an inner passage internally, the inner pipe having a plurality of pipe through holes. The EGR device further comprises a rotary valve accommodated in the inner pipe, the rotary valve having a plurality of valve through holes. The rotary valve is rotatable to communicate the annular passage with the inner passage through the valve through holes and the pipe through holes and to block the inner passage from the annular passage.

According to another aspect of the preset disclosure, an EGR device comprises a housing having an outer pipe and an inner pipe, the inner pipe in a tubular shape and accommodated in the outer pipe to define an annular passage externally with the outer pipe, the inner pipe defining an inner passage internally, the inner pipe having a pipe tubular wall defining at least one through hole extending radially through the pipe tubular wall. The EGR device further comprises a rotary valve in a tubular shape accommodated in the inner pipe, the rotary valve having a valve tubular wall defining at least one valve through hole extending radially through the valve tubular wall. The rotary valve is rotatable in the inner pipe and is configured to increase an overlapped area between the at least one valve through hole and the at least one pipe through hole to further communicate the annular passage with the inner passage, as the rotary valve rotates in an opening direction.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

First Embodiment

Figure 1:
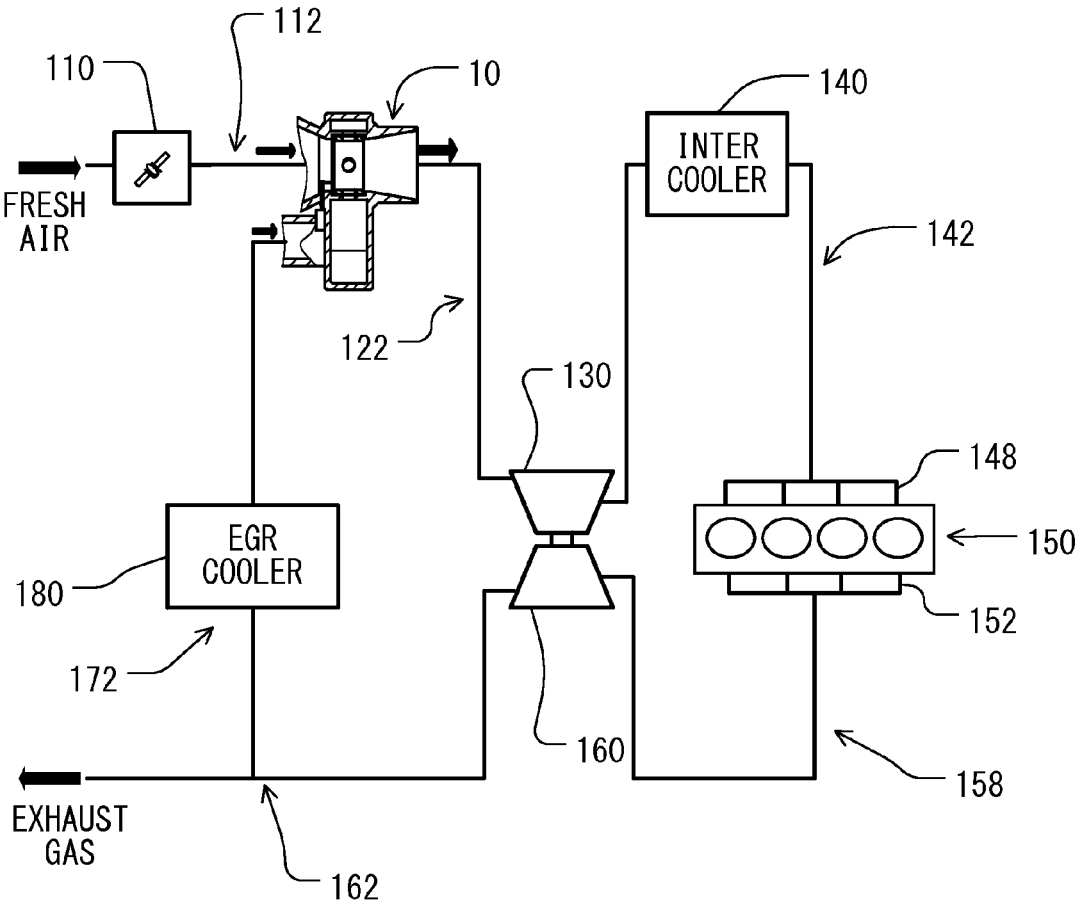
FIG. 1 is a block diagram showing an EGR system for an internal combustion engine of a vehicle.

In the following description, a radial direction is along an arrow represented by "RADIAL" in drawing(s). An axial direction is along an arrow represented by "AXIAL" in drawing(s). A circumferential direction is along an arrow represented by "CIRCUMFERENTIAL" in drawing(s). A horizontal direction is along an arrow represented by "HORIZONTAL" in drawing(s). A flow direction is along an arrow represented by "FLOW" in drawing(s).

As follows, a first embodiment of the present disclosure will be described with reference to FIGS. 1 to 5. As shown FIG. 1, according to the present example, an internal combustion engine 150 has four cylinders connected with an intake manifold 148 and an exhaust manifold 152.

The engine 150 is combined with an intake and exhaust system. The intake and exhaust system includes an intake valve 110, an intake passage 112, an EGR device 10, a mixture passage 122, a turbocharger including a compressor 130 and a turbine 160, a charge air passage 142, and an intercooler 140. The intake and exhaust system further includes a combustion gas passage 158, an exhaust passage 162, an EGR passage 172, and an EGR cooler 180.

The intake passage 112 is equipped with the intake valve 110. The intake passage 112 is connected with the EGR device 10. The EGR device 10 is connected with the compressor 130 through the mixture passage 122. The compressor 130 is connected with the intake manifold 148 through the charge air passage 142. The charge air passage 142 is equipped with the intercooler 140. The exhaust manifold 152 is connected with the turbine 160 through the combustion gas passage 158. The turbine 160 is connected with the exhaust passage 162. The EGR passage 172 is branched from the exhaust passage 162 and connected with the EGR device 10. The EGR passage 172 is equipped with the EGR cooler 180.

The intake passage 112 conducts fresh air from the outside of the vehicle through the intake valve 110 into the EGR device 10. The intake valve 110 regulates a quantity of fresh air flowing through the intake passage 112 into the EGR device 10. The EGR device 10 draws fresh air from the intake passage 112 and draws exhaust gas from the exhaust passage 162 through the EGR passage 172. The EGR device 10 includes an EGR mixer to blend the drawn fresh air with the drawn exhaust gas to produce mixture gas. The mixture passage 122 conducts the mixture gas from the EGR device 10 into the compressor 130.

The compressor 130 is rotatably connected with the turbine 160 via a common axis. The compressor 130 is driven by the turbine 160 to compress the mixture gas. The charge air passage 142 conducts the compressed mixture gas to the intake manifold 148. The intercooler 140 is a heat exchanger to cool the compressed mixture gas conducted through the charge air passage 142.

The engine 150 draws the cooled mixture gas. The engine 150 forms air-fuel mixture with the drawn mixture gas and injected fuel in each cylinder and burns the air-fuel mixture in the cylinder to drive a piston in the cylinder. The engine 150 emits combustion gas (exhaust gas) through the exhaust manifold 152 into the combustion gas passage 158. The combustion gas passage 158 conducts the combustion gas into the turbine 160. The turbine 160 is driven by the exhaust gas to drive the compressor 130 thereby to cause the compressor 130 to compress mixture gas and to press-feed the compressed mixture gas through the charge air passage 142 and the intercooler 140 into the engine 150.

The exhaust passage 162 conducts exhaust gas (combustion gas) from the turbine 160 to the outside of the vehicle. The EGR passage 172 is branched from the exhaust passage 162 at the downstream side of the turbine 160 to recirculate a part of exhaust gas from the exhaust passage 162 into the EGR device 10. The EGR cooler 180 is a heat exchanger to cool exhaust gas flowing though the EGR passage 172 into the EGR device 10. The EGR device 10 is located at a connection among the intake passage 112, the EGR passage 172, and the mixture passage 122. The EGR passage 172 is merged with the intake passage 112 in the EGR device 10.

As described above, the EGR system is configured to recirculate a part of exhaust gas from the exhaust passage 162 into the intake passage 112. The circulated exhaust gas may contain oxygen at a lower percentage compared with oxygen contained in fresh air. Therefore, circulated exhaust gas may dilute mixture of exhaust gas and fresh air thereby to reduce peak temperature of combustion gas when burned in the combustion chamber of the engine 150. In this way, the EGR system may reduce oxidization of nitrogen, which is caused under high temperature, thereby to reduce nitrogen oxide (NOx) occurring in the combustion chamber.

Subsequently, the configuration of the EGR device 10 will be described in detail. As shown in FIGS. 2 to 5, the EGR device 10 includes a housing 20 accommodating a valve (rotary valve) 60, a motor 94, and a linkage 95. The housing 20 is formed of a metallic material such as stainless steel and/or an aluminum alloy.

The housing 20 includes an air inlet 22, an outer pipe 40, an inner pipe 50, an outlet 26, an EGR inlet 28, and an EGR guide 32. The air inlet 22 is connected with the intake passage 112. The outlet 26 is connected with the mixture passage 122. The outer pipe 40 and the inner pipe 50 are located between the air inlet 22 and the outlet 26. The inner pipe 50 is in a tubular shape and is coaxial with the outer pipe 40. The inner pipe 50 is located on the radially inside of the outer pipe 40. The inner pipe 50 has an outer periphery, which defines an annular passage 48 with an inner periphery of the outer pipe 40. The annular passage 48 extends in the circumferential direction. The inner pipe 50 has an inner periphery, which defines an inner passage 52 communicated with the intake passage 112 and the mixture passage 122.

The air inlet 22 has an inner periphery in a tapered shape. The air inlet 22 reduces in inner diameter from its upstream toward the inner pipe 50. The outlet 26 has an inner periphery in a tapered shape. The outlet 26 increases in inner diameter from the inner pipe 50 to its downstream. The air inlet 22, the inner pipe 50, and the outlet 26 form a throttle to reduce a passage at the inner pipe 50.

The inner pipe 50 has multiple pipe through holes 56, which are arranged along the circumferential direction. According to the present example, the inner pipe 50 has four pipe through holes 56, which are arranged substantially at angular intervals, such as 90-degree intervals. Each of the pipe through holes 56 extends along the radial direction through a pipe tubular wall of the inner pipe 50. The pipe through hole 56 is directed substantially at 90 degrees relative to a center axis of the inner pipe 50. The pipe through hole 56 is in a circular shape.

The EGR inlet 28 is connected with the EGR passage 172. The EGR inlet 28 is communicated with an EGR channel 46 defined in the EGR guide 32. The EGR channel 46 is communicated with the annular passage 48.

The inner pipe 50 accommodates the valve 60. The valve 60 is in a tubular shape and is rotatable in the inner pipe 50. In the present example, the valve 60 is rotatably supported by bearings 58 at both ends in the axial direction. The valve 60 and the bearings 58 are accommodated in a groove, which is formed between the air inlet 22 and the outlet 26 and located on the radially inside of the inner pipe 50. The valve 60 has multiple valve through holes 66, which are arranged along the circumferential direction. According to the present example, the valve 60 has four valve through holes 66, which are arranged substantially at angular intervals, such as 90-degree intervals, correspondingly to the inner pipe 50. Each of the valve through holes 66 extends along the radial direction through a valve tubular wall of the valve 60. The valve through hole 66 is directed substantially at 90 degrees relative to the center axis of the inner pipe 50. In the present first embodiment, the valve through hole 66 is in a circular shape. The valve 60 may function as an EGR mixer.

An electronic control unit (ECU) 98 is electrically connected with the motor 94 to control electricity supplied to the motor 94. In the present example, the valve 60 is coupled with the linkage 95 and is operable by the motor 94 via the linkage 95. For example, the linkage 95 includes a rod 97 and an arm 96. The rod 97 extends from an end of the valve 60 in the axial direction. The arm 96 extends from the motor 94 to be coupled with the rod 97 at one end. The ECU 98 controls the motor 94 to, for example, push and pull the arm 96 thereby to rotate the valve 60 via the rod 97.

The valve 60 is rotatable in an opening direction and a closing direction between a full open position and a full close position. When the valve 60 is at the full open position, the valve through holes 66 are overlapped with the pipe through holes 56 respectively. Thus, the inner passage 52 is communicated with the annular passage 48 through the valve through holes 66 and the pipe through holes 56. When the valve 60 is at the full close position, the valve through holes 66 are overlapped with an inner periphery of the inner pipe 50. Therefore, the inner passage 52 is isolated from the annular passage 48.

Figure 2:
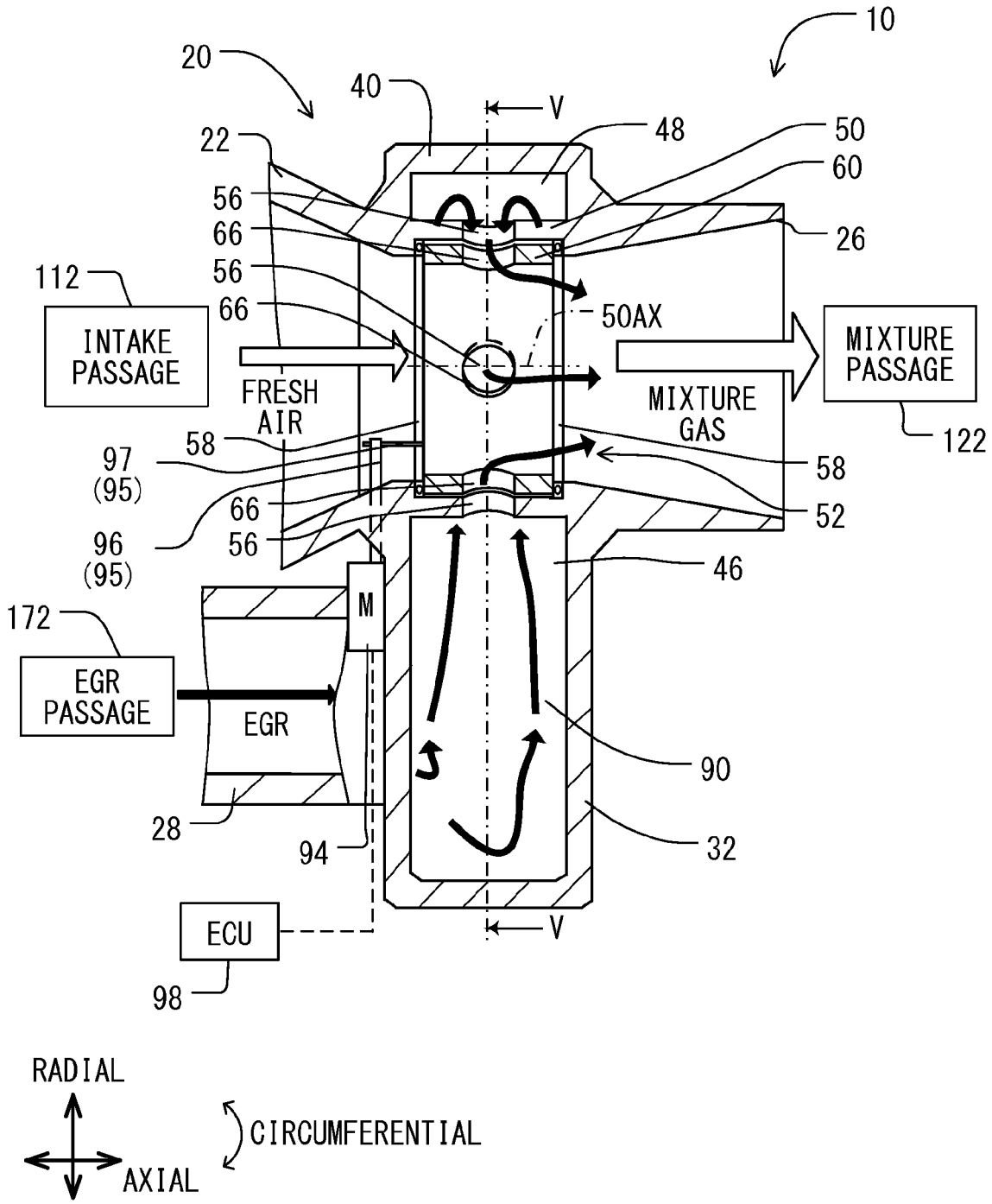
FIG. 2 is a sectional view showing an EGR device for the EGR system substantially at a full open position, according to a first embodiment.

FIG. 2 shows the valve 60 substantially at the full open position where the valve through holes 66 are approximately overlapped with the pipe through holes 56 respectively. In the present state, the EGR device 10 enables to flow EGR gas from the EGR passage 172 to pass through the annular passage 48 into the inner passage 52 radially inward through the pipe through holes 56 and the valve though holes 66.

Figure 3:
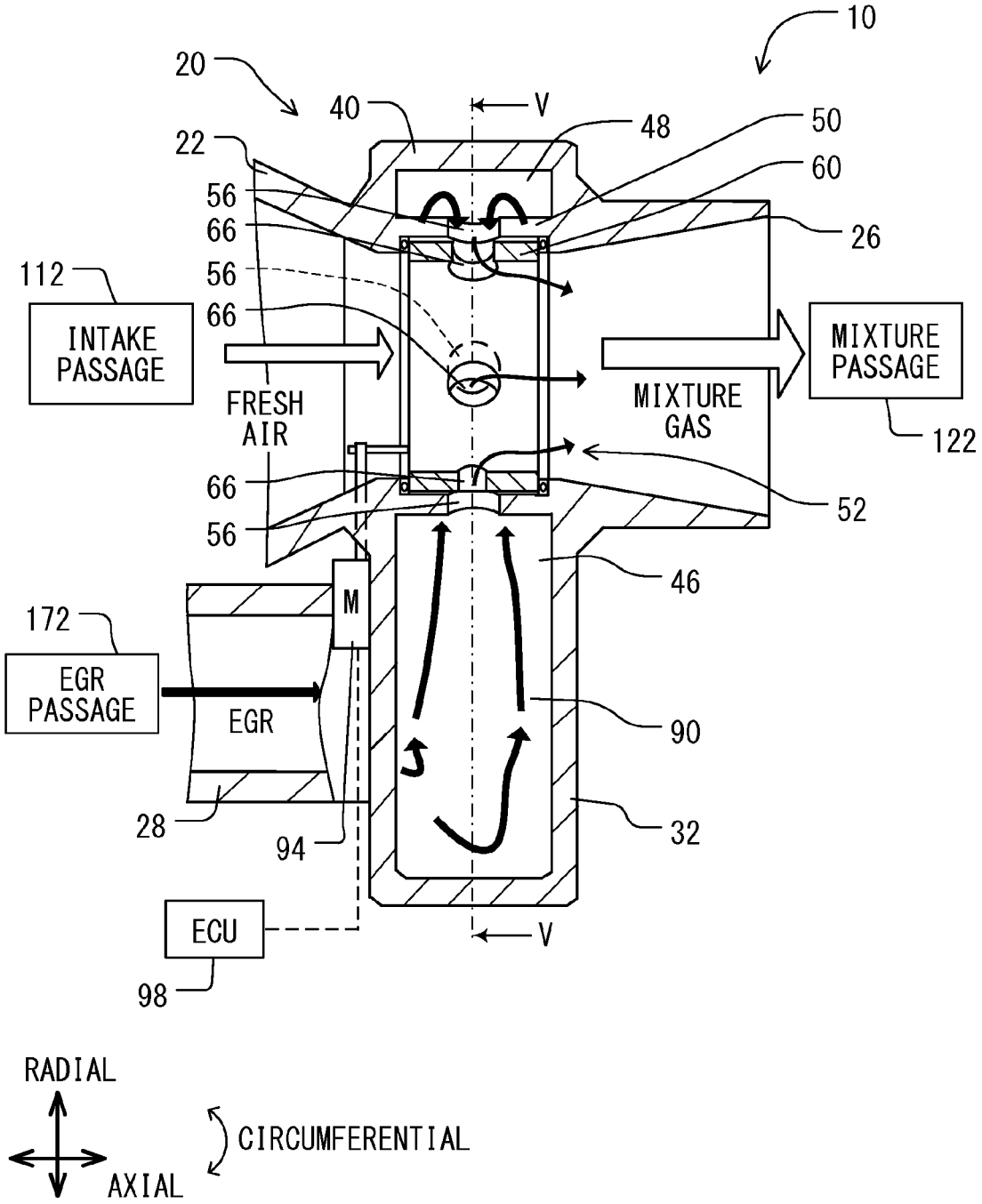
FIG. 3 is a sectional view showing the EGR device at an intermediate position, according to the first embodiment.

FIG. 3 shows the valve 60 at an intermediate position between the full open position and the full close position. At the intermediate position, the valve 60 is rotated from the substantially full open position in FIG. 2 in the closing direction by a certain rotational angle. In the present state, the valve through holes 66 are partially overlapped with the pipe through holes 56 respectively and are partially overlapped with the inner periphery of the inner pipe 50. Thus, the EGR device 10 enables EGR gas to flow from the annular passage 48 into the inner passage 52 radially inward through overlapped areas between the pipe through holes 56 and the valve though holes 66. Thus, the EGR device 10 reduces a quantity of EGR gas flowing into the inner passage 52, compared with the substantially full close position.

Figure 4:
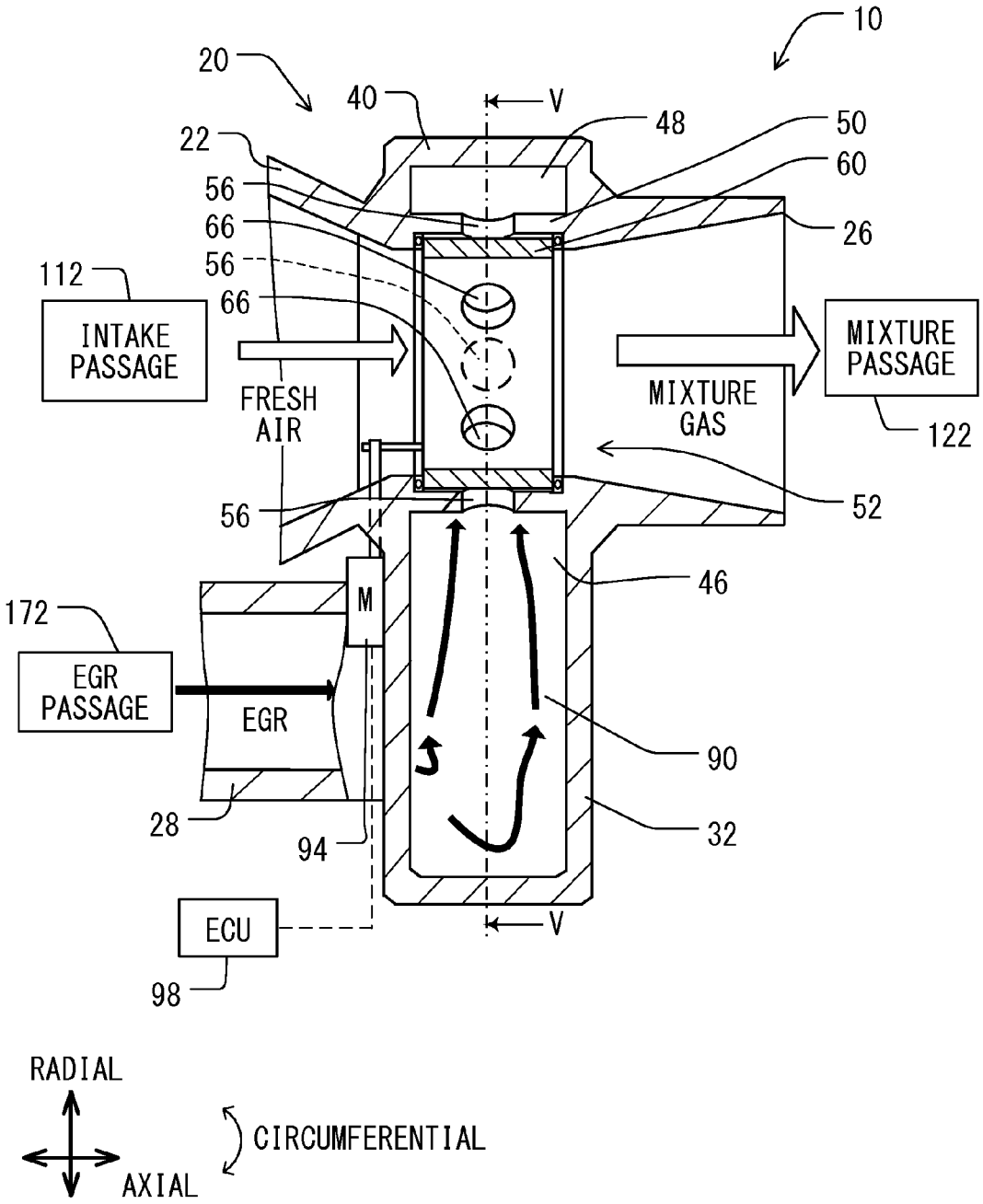
FIG. 4 is a sectional view showing the EGR device at a full close position, according to the first embodiment.

FIG. 4 shows the valve 60 at the full close position. The valve 60 is rotated from the intermediate position in FIG. 3 in the closing direction by a certain rotational angle. In the present state, the valve through holes 66 are entirely overlapped with the inner periphery of the inner pipe 50. Thus, the EGR device 10 disables EGR gas to flow from the annular passage 48 into the inner passage 52.

In this way, the ECU 98 manipulates the motor 94 to control the rotational position of the valve 60 relative to the inner pipe 50 thereby to control a quantity of EGR gas flowing from the annular passage 48 into the inner passage 52.

In FIG. 2, the air inlet 22, the inner pipe 50, the valve 60, and the outlet 26 may be configured to throttle the inner passage 52 and to cause Venturi effect at the valve 60 to increase flow velocity of fresh air and to cause negative pressure at the valve 60. Thus, the configuration may facilitate to induce EGR gas from the annular passage 48 into the inner passage 52 through the pipe through holes 56 and the valve through holes 66 and to blend the EGR gas with fresh air.

The pipe through holes 56 and the valve through holes 66 extend from the annular passage 48 toward the inner passage 52 to throttle EGR gas flow and to expand and diffuse EGR gas into fresh air passing through the inner passage 52. Thus, the present configuration may enable EGR gas to be homogeneously and evenly blended with fresh air in the inner passage 52 to produce uniform mixture gas.

Figure 5:
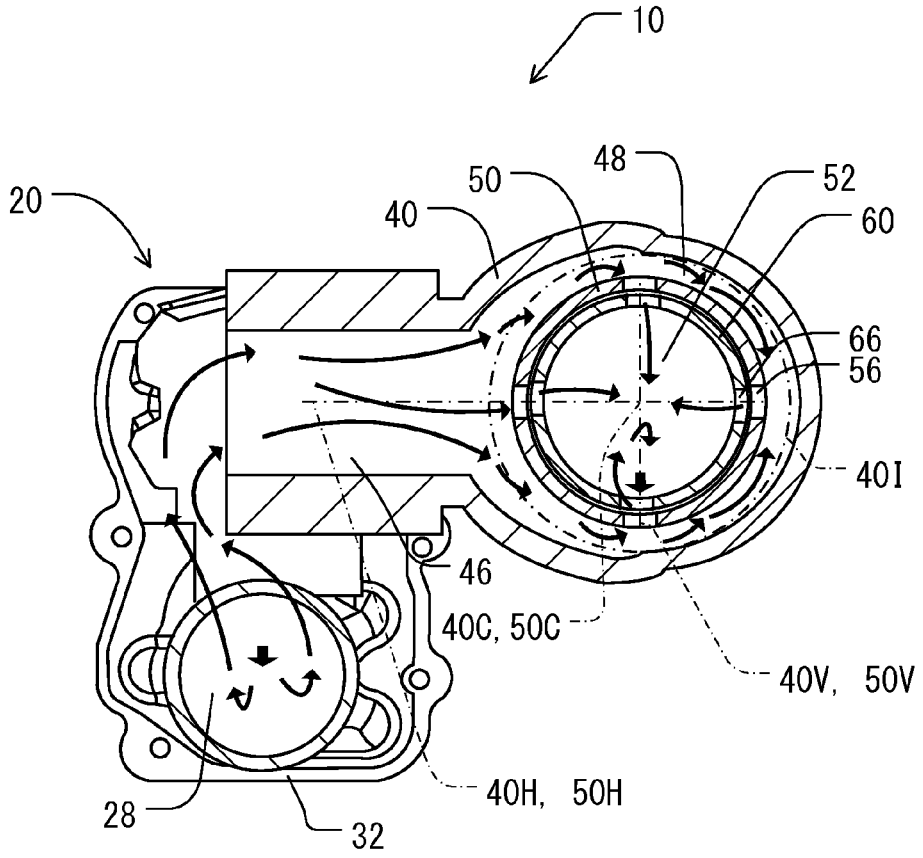
FIG. 5 is a sectional view showing the EGR device, the sectional view corresponding to a section taken along the line V-V in FIG. 2.
Figure 5:
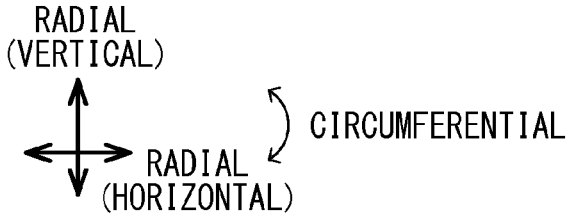

FIG. 5 shows the EGR device 10 in which the valve 60 is substantially at the full open position corresponding to FIG. 2. In FIG. 5, the EGR device 10 enables to flow EGR gas from the EGR passage 172 to flow through the annular passage 48 circumferentially and further to flow the EGR gas into the inner passage 52 radially inward through the pipe through holes 56 and the valve though holes 66. The annular passage 48 leads EGR gas to flow from the EGR channel 46 and to flow entirely around the outer periphery of the inner pipe 50 toward the opposite side of the EGR channel 46. Thus, the annular passage 48 may enable to distribute EGR gas evenly around the inner pipe 50 in the circumferential direction.

In FIG. 5, the inner pipe 50 has a cross section having a vertical center 50V, a horizontal center 50H, and a center point 50C, which is an intersection between the vertical center 50V and the horizontal center 50H. The inner periphery of the outer pipe 40 has a cross section defining an inscribe circle 40I, which has a vertical center 40V, a horizontal center 40H, and a center point 40C, which is an intersection between the vertical center 40V and the horizontal center 40H. In the present example, the inner pipe 50 and the outer pipe 40 are substantially coaxial with each other. Specifically, the center point 50C of the inner pipe 50 and the center point 40C of the inscribe circle 40I of the outer pipe 40 substantially coincide with each other.

The motor 94 and the linkage 95 are one example of the actuator. Instead of or in addition to the motor 94 and the linkage 95, various configuration may be employed for the actuator to rotate the valve 60. For example, the actuator may include a solenoid device, a hydraulic or pneumatic device, or the like.

Second Embodiment

Figure 6:
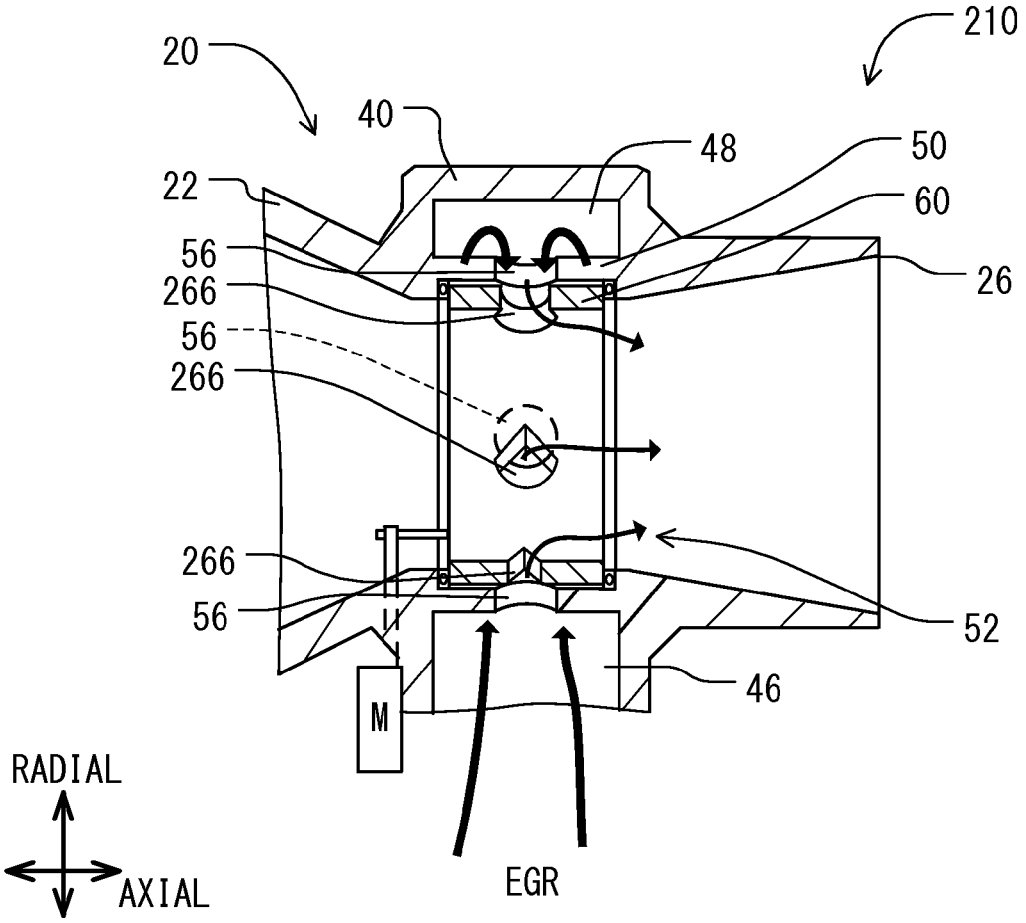
FIG. 6 is a sectional view showing an EGR device according to a second embodiment.
Figure 7:
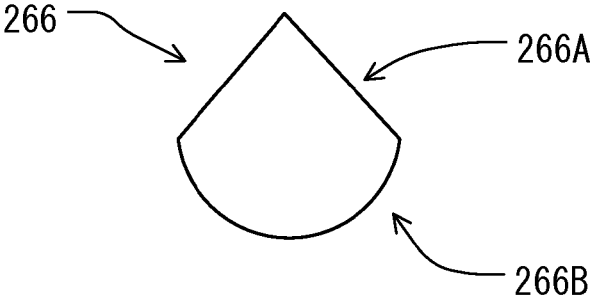
FIG. 7 is a schematic view showing a valve through hole of the EGR device according to the second embodiment.

As shown in FIGS. 6 and 7, according to the present second embodiment, an EGR device 210 includes a valve 260 having valve through holes 266 each being in a shape different from the shape of the valve through hole 66 of the first embodiment. The valve through hole 266 is in a V-notch shape including a combination of a triangular portion 266A and a hemispheric portion 266B. The triangular portion 266A is located on a forward side relative to the hemispheric portion 266B when the valve 260 rotates in the opening direction. When the valve 260 rotates in the opening direction, a tip end of the triangular portion 266A first overlaps with the pipe through hole 56, and subsequently, a body of the triangular portion 266A further overlaps with the pipe through hole 56. Subsequently, the hemispheric portion 266B further overlaps with the pipe through hole 56, and thus, the valve through hole 266 entirely overlaps with the pipe through hole 56. According to the present configuration, an overlapped area between the triangular portion 266A and the pipe through hole 56 is initially small and may increase gradually. The present configuration may restrict drastic increase in the overlapped area when the valve 260 rotates in the opening direction.

Third Embodiment

Figure 8:
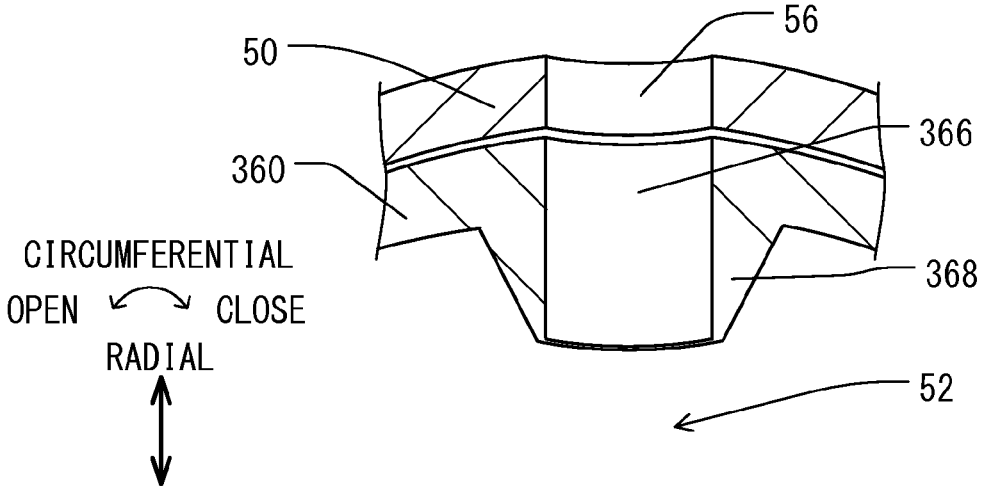
FIG. 8 is a sectional view showing a part of an EGR device according to a third embodiment.

As shown in FIG. 8, according to the present third embodiment, a valve 360 has a throat portion 368 on each of the valve through holes 366. The throat portion 368 extends radially inward from the inner periphery of the valve 360 to form an extended passage from the valve through hole 366. The throat portion 368 is substantially in a conical shape reduced in the outer diameter as extending radially inward into the inner passage 52. In the present example, four throat portions 368 extend radially inward to form a circular array and further to throttle the inner passage 52 in addition to the air inlet 22 and the outlet 26. The through hole in the throat portion 368 may form a conical passage reduced in the inner diameter as extending radially inward into the inner passage 52 to define a throttled passage.

Fourth Embodiment

As shown in FIG. 8, according to the present fourth embodiment, an EGR device 410 is equipped with a cage 470. The cage 470 is located on the radially inside of the inner periphery of the inner pipe 50.

The cage 470 includes rings 472 and 476 and baffles 474. The ring 472 is in an annular shape and affixed to the inner periphery of the air inlet 22 by, for example, welding or press-insertion. The ring 476 is in an annular shape and affixed to the inner periphery of the outlet 26 by, for example, welding or press-insertion. Each of the baffles 474 linearly extends along a center axis 50AX of the inner pipe 50. The baffle 474 is located between the rings 472 and 476 and supported at both ends. In this way, the rings 472 and 476 are bridged with the baffles 474. In the present example, the cage 470 includes four baffles 474 correspondingly to the four valve through holes 66. The baffles 474 extend on the radially inside of the pipe through holes 56 respectively and on the radially inside of the inner periphery of the valve 60.

Figure 10:
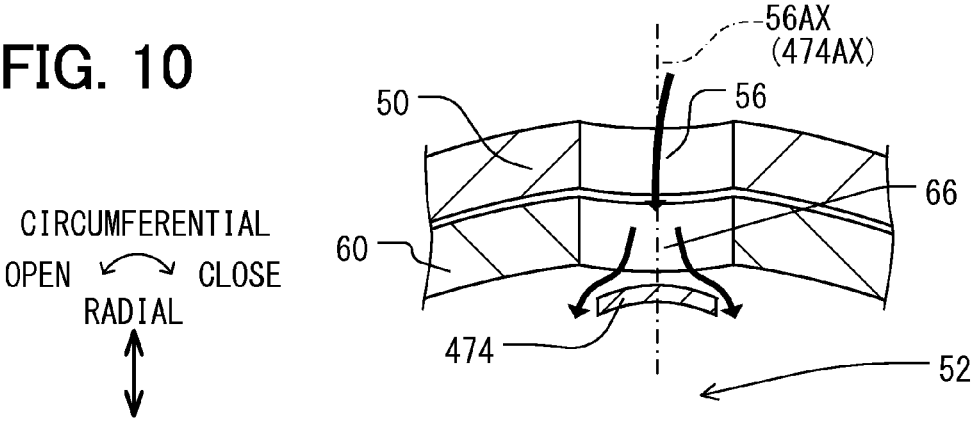
FIG. 10 is a sectional view showing a part of the EGR device according to the fourth embodiment.

As shown in FIG. 10, according to the present example, the baffle 474 and the pipe through hole 56 have a common center axis 56AX. The baffle 474 is opposed to the valve through hole 66 at least when the valve 60 is at the full open position. As shown by the arrows, the baffle 474 baffles EGR flow entering the inner passage 52 and may diffuse the EGR flow into the inner passage 52.

The baffle 474 may have a curvature greater than a curvature of the inner periphery of the valve 60. That is, the baffle 474 may be convex radially outward toward the valve through hole 66 when opposed to the valve through hole 66 to deflect the EGR flow radially inward.

Fifth Embodiment

Figure 9:
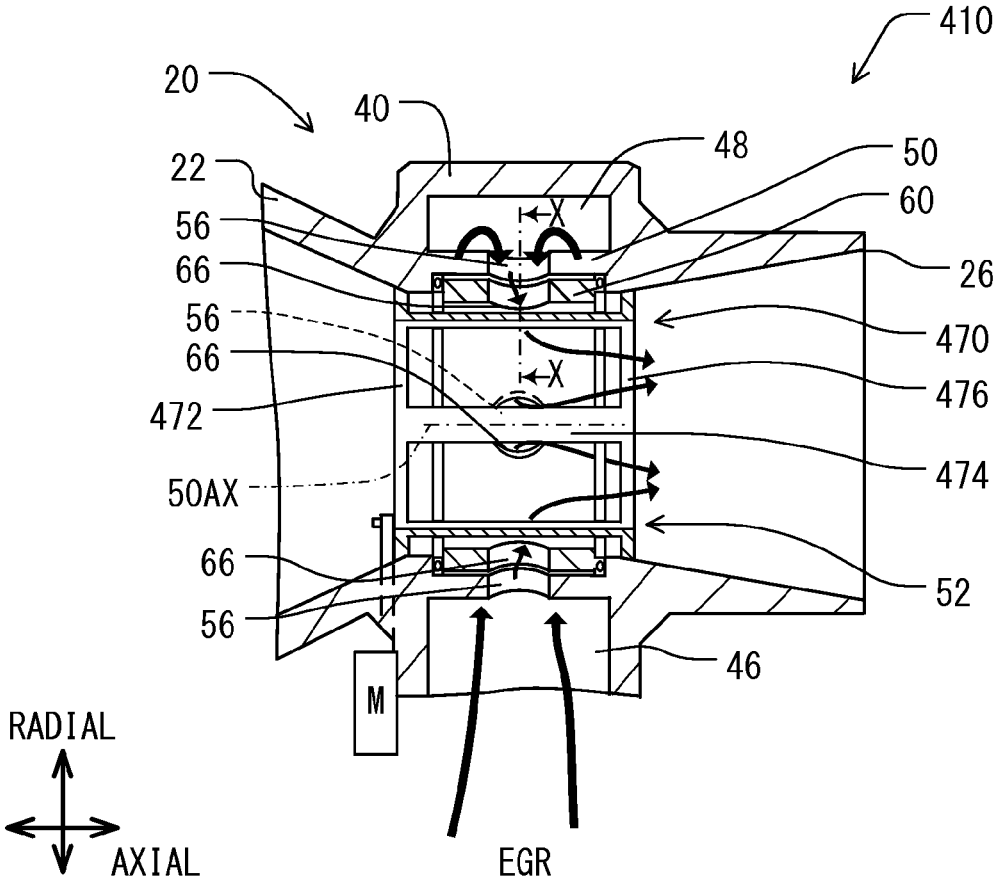
FIG. 9 is a sectional view showing an EGR device according to a fourth embodiment.
Figure 11A:
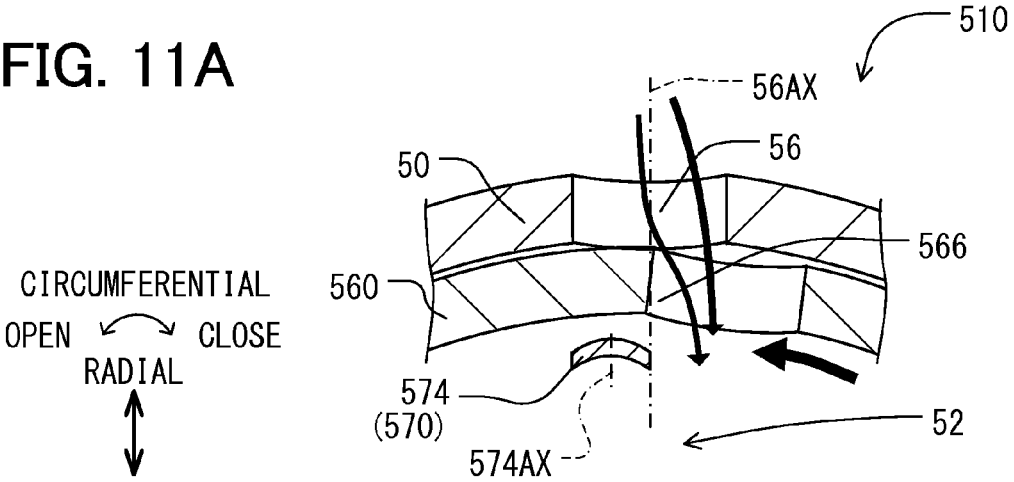
FIG. 11A is a sectional view showing a part of the EGR device at an intermediate position according to a fifth embodiment.
Figure 11B:
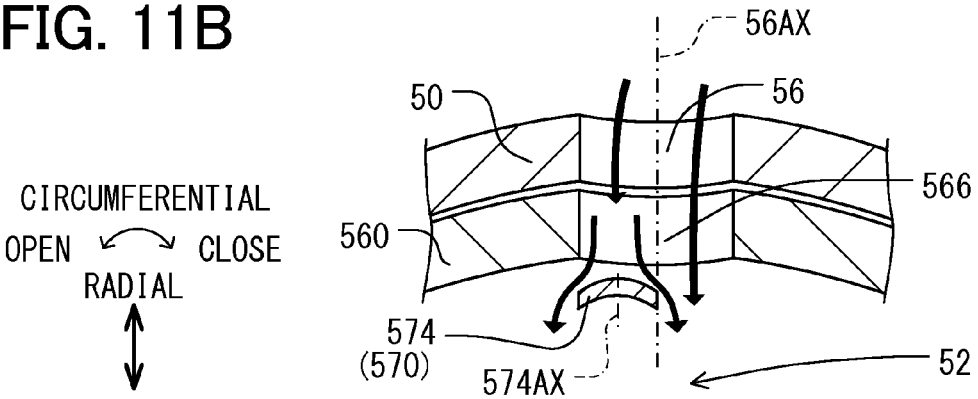
FIG. 11B is a sectional view showing the part of the EGR device at a full open position.

As shown in FIGS. 11A and 11B, according to the present fifth embodiment, an EGR device 510 is equipped with baffles 574. The baffles 574 are a part of a cage 570 having a similar configuration to that of the fourth embodiment. The baffles 574 extend along the center axis 50AX (FIG. 9) of the inner pipe 50 on the radially inside of the inner periphery of the inner pipe 50.

According to the present example, the baffle 574 is offset from the pipe through hole 56 in the opening direction. For example, the baffle 574 has a center axis 574AX, which is offset from the center axis 56AX of the pipe through hole 56 in the opening direction.

FIG. 11A shows a valve 560 at an intermediate position after rotating from the full close position in the opening direction. At the intermediate position, each of valve through hole 566 of the valve 560 partially overlaps with each of the pipe through holes 56 thereby to enable EGR gas flow to pass therethrough into the inner passage 52 while throttling the EGR gas flow. The throttled EGR gas may expand largely after passing through the overlapped area between the pipe through holes 56 and the valve through holes 566 and may diffuse into the inner passage 52. In the present state, the baffles 574 are covered with the inner periphery of the inner pipe 50 and are not opposed to the valve through hole 566 directly. Therefore, the baffles 574 may not interfere with the EGR gas flow entering the inner passage 52.

FIG. 11B shows the valve 560 at the full open position after rotating further from the intermediate position in the opening direction. At the full open position, the valve through holes 566 entirely overlap with the pipe through holes 56 respectively. In the present state, the baffles 574 are entirely opposed to a part of the valve through holes 566 to baffle EGR gas flow entering the inner passage 52. In the present example, each of the baffles 574 is entirely opposed substantially to a half of the valve through holes 566.

When the valve 560 is at the full open position, the pipe through holes 56 and the valve through holes 566 may widely open and may less diffuse the EGR flow compared with the state at the intermediate position. The present configuration may enable to diffuse the EGR gas flow selectively at the full open position.

In the present example, one end of the baffle 574 is on the center axis 56AX of the pipe through hole 56 and the other end of the baffle 574 is located at the end of the pipe through hole 56. The baffle 574 may extend in the circumferential direction beyond the center axis 56AX and/or beyond the end of the pipe through hole 56. The baffle 574 may be smaller than the configuration of FIG. 11B and may extend in the circumferential direction to a position before the center axis 56AX and/or to a position before the end of the pipe through hole 56.

Other Embodiment

Various combinations of the valve, the inner pipe, and other components of the EGR device according to the above-described embodiments may be arbitrary employed.

The through holes of the valve and the inner pipe may employ various forms. For example, the through holes may employ various numbers, various sizes, various arrangements, and/or various shapes. For example, the through holes may employ various shapes such as an oval shape, a polygonal shape, or a star shape, in addition to the shape of the second embodiment. Various combinations of the through holes of the above-described embodiments may be arbitrary employed.

The through holes may be unevenly arranged. For example, the through holes may be concentrically formed on the opposite side of the EGR channel.

The through hole(s) on the side of the EGR channel may be omitted. At least one of the air inlet and the outlet may not define the inclined passage and may define a straight passage.

The through holes may have different diameters. For example, through holes may by formed to have diameters increased from the side of the EGR channel toward the opposite side of the EGR channel.

The number of the valve through holes and the pipe through holes on the upstream side of EGR gas flow may be smaller than the number of the valve through holes and the pipe through holes on the downstream side of EGR gas flow.

The inner pipe and the valve may be offset relative to the outer pipe, such that the vertical center of the outer pipe is offset from the vertical center of the inner pipe in the radial direction. More specifically, the outer pipe and the inner pipe may be offset in relation to each other so that a distance between the outer pipe and the inner pipe progressively decreases from the EGR channel to the opposite side of the EGR channel. In this case, an annular passage formed between the outer pipe and the inner pipe may be gradually reduced in passage area toward the opposite side of the EGR channel.

The valve may be rotatably supported at the circumferential periphery in the inner pipe. The opening direction and the closing direction of the valve may be opposite from those in the above-described examples.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An EGR device comprising:

a housing having an outer pipe and an inner pipe, the inner pipe accommodated in the outer pipe to define an annular passage externally with the outer pipe, the inner pipe defining an inner passage internally, the inner pipe having a plurality of pipe through holes; and a rotary valve accommodated in the inner pipe, the rotary valve having a plurality of valve through holes, wherein the rotary valve is rotatable to communicate the annular passage with the inner passage through the valve through holes and the pipe through holes and to block the inner passage from the annular passage, at least one of the valve through holes overlaps with at least one of the pipe through holes to form an overlapped area therebetween to communicate the annular passage with the inner passage therethrough, and the overlapped area increases in size as the rotary valve rotates in an opening direction.

2. The EGR device according to claim 1, wherein the rotary valve is in a tubular shape and has a valve tubular wall, the valve through holes extend radially through the valve tubular wall, the inner pipe is in a tubular shape and has a pipe tubular wall, and the pipe through holes extend radially through the pipe tubular wall.

3. The EGR device according to claim 2, wherein the rotary valve is located radially inside the inner pipe, and the rotary valve is coaxial with the inner pipe.

4. The EGR device according to claim 1, wherein the housing further has an air inlet and an outlet, the air inlet located on an upstream side of the inner pipe, the outlet located on a downstream side of the inner pipe, the air inlet has an inner periphery in a tapered shape and reduces in inner diameter from an upstream toward the inner pipe, the outlet has an inner periphery in a tapered shape and increases in inner diameter from the inner pipe to a downstream, and the air inlet, the inner pipe, and the outlet form a throttle to reduce a passage at the inner pipe.

5. The EGR device according to claim 1, wherein at least one of the pipe through holes is in a circular shape, and at least one of the valve through holes is in a circular shape.

6. The EGR device according to claim 1, wherein the inner pipe is offset from the outer pipe.

7. An EGR device comprising:

a housing having an outer pipe and an inner pipe, the inner pipe accommodated in the outer pipe to define an annular passage externally with the outer pipe, the inner pipe defining an inner passage internally, the inner pipe having a plurality of pipe through holes; and a rotary valve accommodated in the inner pipe, the rotary valve having a plurality of valve through holes, wherein the rotary valve is rotatable to communicate the annular passage with the inner passage through the valve through holes and the pipe through holes and to block the inner passage from the annular passage, wherein the valve through holes overlap entirely with the pipe through holes when the rotary valve is at a full open position, and the valve through holes overlap entirely with an inner periphery of the inner pipe when the rotary valve is at a full open position.

8. The EGR device according to claim 7, wherein the valve through holes overlap partially with the pipe through holes and partially with the inner periphery of the inner pipe when the rotary valve is at an intermediate position between the full open position and the full open position.

9. The EGR device according to claim 8, wherein the rotary valve is rotatable in an opening direction from the full close position through the intermediate portion to the full open position, and the rotary valve is rotatable in a closing direction from the full open position through the intermediate portion to the full close position.

10. An EGR device comprising:

a housing having an outer pipe and an inner pipe, the inner pipe accommodated in the outer pipe to define an annular passage externally with the outer pipe, the inner pipe defining an inner passage internally, the inner pipe having a plurality of pipe through holes; and a rotary valve accommodated in the inner pipe, the rotary valve having a plurality of valve through holes, wherein the rotary valve is rotatable to communicate the annular passage with the inner passage through the valve through holes and the pipe through holes and to block the inner passage from the annular passage, wherein at least one of the pipe through holes is in a circular shape, and at least one of the valve through holes is in a V-notch shape including a triangular portion and a hemispheric portion.

11. An EGR device comprising:

a housing having an outer pipe and an inner pipe, the inner pipe accommodated in the outer pipe to define an annular passage externally with the outer pipe, the inner pipe defining an inner passage internally, the inner pipe having a plurality of pipe through holes; and a rotary valve accommodated in the inner pipe, the rotary valve having a plurality of valve through holes, wherein the rotary valve is rotatable to communicate the annular passage with the inner passage through the valve through holes and the pipe through holes and to block the inner passage from the annular passage, wherein at least one of the valve through holes is equipped with a throat portion being in a conical shape and extending radially inward into the inner passage.

12. An EGR device comprising:

a housing having an outer pipe and an inner pipe, the inner pipe accommodated in the outer pipe to define an annular passage externally with the outer pipe, the inner pipe defining an inner passage internally, the inner pipe having a plurality of pipe through holes; and a rotary valve accommodated in the inner pipe, the rotary valve having a plurality of valve through holes, wherein the rotary valve is rotatable to communicate the annular passage with the inner passage through the valve through holes and the pipe through holes and to block the inner passage from the annular passage, wherein the valve through holes is equipped with a plurality of throat portions respectively to form a circular array coaxial with the inner pipe, and each of the throat portions is in a conical shape and extending radially inward into the inner passage.

13. An EGR device comprising:

a housing having an outer pipe and an inner pipe, the inner pipe accommodated in the outer pipe to define an annular passage externally with the outer pipe, the inner pipe defining an inner passage internally, the inner pipe having a plurality of pipe through holes; and a rotary valve accommodated in the inner pipe, the rotary valve having a plurality of valve through holes, wherein rotary valve is rotatable to communicate the annular passage with the inner passage through the valve through holes and the pipe through holes and to block the inner passage from the annular passage, wherein at least one baffle extending on a radially inside of an inner periphery of the inner pipe, wherein the at least one baffle is configured to be opposed to at least one of the valve through holes.

14. The EGR device according to claim 13, wherein the at least one baffle and at least one of the pipe through holes have a common center axis.

15. The EGR device according to claim 13, wherein at least one of the valve through holes is configured to overlap with at least one of the pipe through holes to form an overlapped area therebetween to communicate the annular passage with the inner passage, the overlapped area increases in size as the rotary valve rotates in the opening direction, and the at least one baffle is offset from corresponding one of the pipe through holes in the opening direction.

16. An EGR device comprising:

a housing having an outer pipe and an inner pipe, the inner pipe accommodated in the outer pipe to define an annular passage externally with the outer pipe, the inner pipe defining an inner passage internally, the inner pipe having a plurality of pipe through holes; and a rotary valve accommodated in the inner pipe, the rotary valve having a plurality of valve through holes, wherein the rotary valve is rotatable to communicate the annular passage with the inner passage through the valve through holes and the pipe through holes and to block the inner passage from the annular passage, wherein at least one of the valve through holes on an upstream side is smaller than at least one of an other of the valve through holes on a downstream side.

17. An EGR device comprising:

a housing having an outer pipe and an inner pipe, the inner pipe accommodated in the outer pipe to define an annular passage externally with the outer pipe, the inner pipe defining an inner passage internally, the inner pipe having a plurality of pipe through holes; and a rotary valve accommodated in the inner pipe, the rotary valve having a plurality valve through holes, wherein the rotary valve is rotatable to communicate the annular passage with the inner passage through the valve through holes and the pipe through holes and to block the inner passage from the annular passage, wherein a number of the valve through holes on an upstream side is smaller than a number of the valve through holes on a downstream side.

* * * * *